US008951022B2

(12) United States Patent
Mauchle et al.

(10) Patent No.: US 8,951,022 B2
(45) Date of Patent: Feb. 10, 2015

(54) FEEDING DEVICE FOR POWDER SPRAY COATING DEVICE

(75) Inventors: Felix Mauchle, Abtwil (CH); Christian Marxer, Fuerstentum (LI); Thomas Staub, Gossau (CH)

(73) Assignee: Gema Switzerland GmbH, St Gallen (CH)

( * ) Notice: Subject to any disclaimer, the term of this patent is extended or adjusted under 35 U.S.C. 154(b) by 350 days.

(21) Appl. No.: 12/681,013

(22) PCT Filed: Sep. 19, 2008

(86) PCT No.: PCT/IB2008/002454

§ 371 (c)(1),
(2), (4) Date: Mar. 31, 2010

(87) PCT Pub. No.: WO2009/047602

PCT Pub. Date: Apr. 16, 2009

(65) Prior Publication Data

US 2010/0213281 A1 Aug. 26, 2010

(30) Foreign Application Priority Data

Oct. 13, 2007 (DE) ..... 10 2007 049 219

(51) Int. Cl.
*E21B 43/12* (2006.01)
*B05B 7/14* (2006.01)

(52) U.S. Cl.
CPC ..... *B05B 7/1459* (2013.01)
USPC ..... 417/65; 417/394; 417/187; 406/50; 406/90

(58) Field of Classification Search
USPC ..... 417/46, 185, 187, 188, 190, 65, 394; 239/329–334, 349, 351, 355, 356, 363; 406/50, 90; 137/565.01
See application file for complete search history.

(56) References Cited

U.S. PATENT DOCUMENTS 4,268,005 A * 5/1981 Raftis et al. ..... 251/5
4,630,635 A * 12/1986 Bernstein et al. ..... 137/315.07

(Continued)

FOREIGN PATENT DOCUMENTS

DE 19611533 B4 11/2005
EP 1752399 A1 2/2007

(Continued)

OTHER PUBLICATIONS

ISR for PCT/IB2008/002454 dated Feb. 18, 2009.

*Primary Examiner* — Devon Kramer
*Assistant Examiner* — Joseph Herrmann
(74) *Attorney, Agent, or Firm* — Lowe Hauptman & Ham LLP

(57) ABSTRACT

A powder feed apparatus for a powder spraycoating equipment includes a dense phase powder pump fitted with at least one, or two feed chambers. Each of the feed chambers includes at one chamber end a powder intake valve and at the opposite chamber end a powder outlet valve and further includes at least one air exchange aperture to alternatingly apply compressed conveying air or a partial vacuum to the feed chamber. The apparatus further includes an integral structural block. The structural block includes the feed chambers and first control valves connected in fluid communication to at least one of feed chambers for the purpose of applying compressed conveying air and a partial vacuum to it. The first control valves are directly connected, in fluid communication via ducts constituted in the structural block, to at least one of the feed chambers.

13 Claims, 7 Drawing Sheets

(56) References Cited

U.S. PATENT DOCUMENTS

Figure 1:
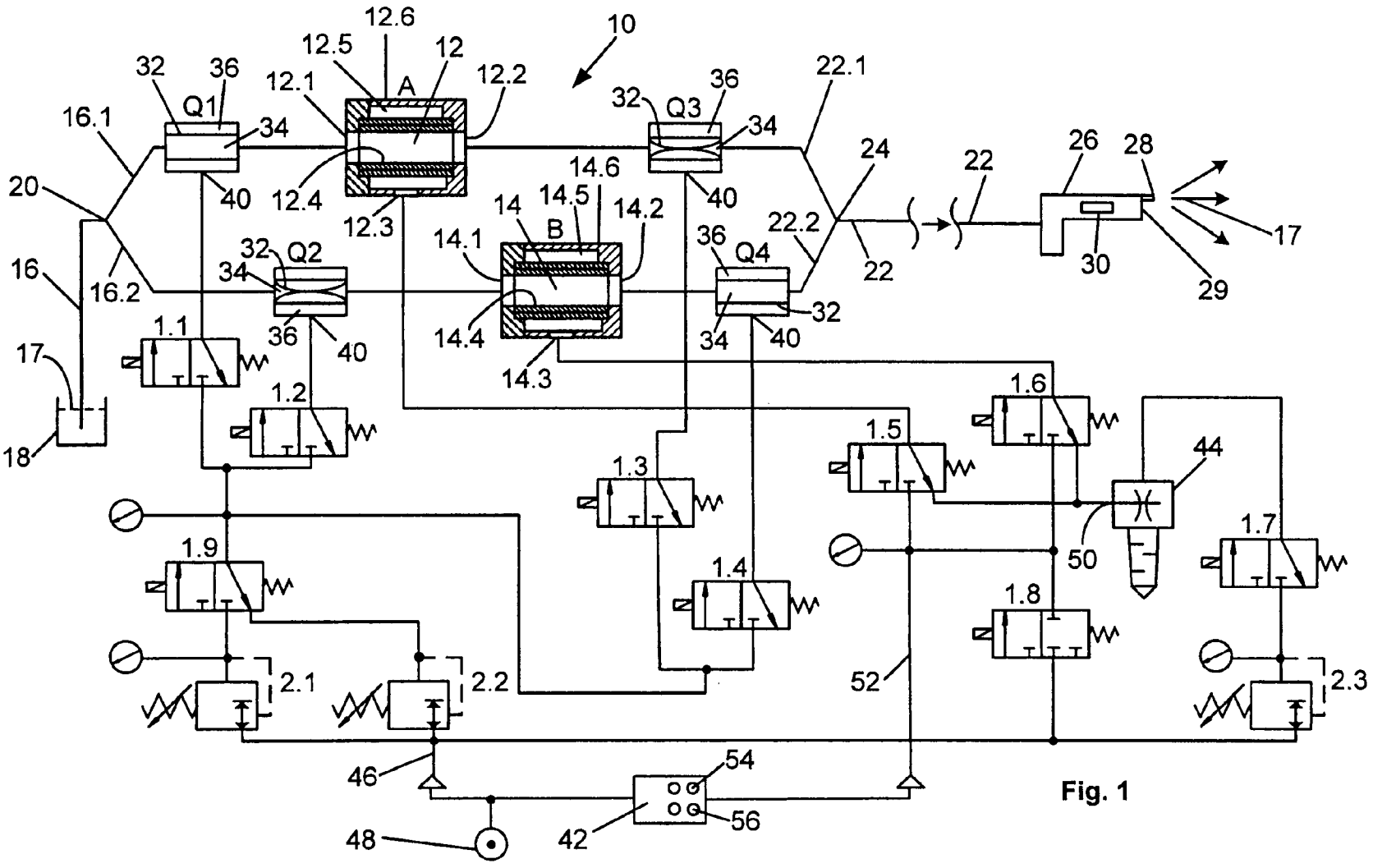

| | | | | |
|---|---|---|---|---|
| 4,682,755 | A * | 7/1987 | Bernstein et al. | 251/4 |
| 4,830,055 | A * | 5/1989 | Kolibas | 137/884 |
| 5,702,209 | A * | 12/1997 | Mauchle | 406/12 |
| RE36,036 | E * | 1/1999 | Engle | 303/3 |
| 7,150,585 | B2 * | 12/2006 | Kleineidam et al. | 406/50 |
| 7,241,080 | B2 * | 7/2007 | Klobucar et al. | 406/50 |
| 7,287,964 | B2 * | 10/2007 | Sanwald | 417/397 |
| 7,452,166 | B2 * | 11/2008 | von Keudell et al. | 406/98 |
| 7,731,456 | B2 * | 6/2010 | Fulkerson et al. | 406/97 |
| 2005/0012476 | A1 | 1/2005 | Yamasaki et al. | |
| 2005/0095071 | A1 | 5/2005 | Kleineidam et al. | |
| 2005/0126476 | A1 | 6/2005 | Shutic et al. | |
| 2005/0178325 | A1 | 8/2005 | Herre et al. | |
| 2006/0193704 | A1 | 8/2006 | Simontacchi | |
| 2007/0092380 | A1 * | 4/2007 | Fulkerson et al. | 417/65 |

FOREIGN PATENT DOCUMENTS

| | | | |
|---|---|---|---|
| EP | 1772195 | A2 | 4/2007 |
| JP | 9071325 | A | 3/1997 |

* cited by examiner

FEEDING DEVICE FOR POWDER SPRAY COATING DEVICE

RELATED APPLICATIONS

The present application is national phase of PCT/IB2008/002454, filed Sep. 19, 2008, and claims priority from, German Application Number 10 2007 049 219.9, filed Oct. 13, 2007, the disclosures of which are hereby incorporated by reference herein in their entirety.

The present invention relates to a feeding device for powder spray coating devices, and to a powder feed apparatus containing a dense phase powder pump fitted with at least one, preferably two feed chambers.

Dense phase powder pumps comprise at least one feed chamber fitted with a powder intake valve and a powder outlet valve. The feed chamber is alternatingly connected to a vacuum source during a suction stage and to a source of compressed conveying air during a discharge stage. The vacuum from said vacuum source aspirates powder through the open powder intake valve into the feed chamber while the powder outlet valve is closed. The compressed conveying air from the source of compressed conveying air discharges powder from within the feed chamber through the open outlet valve while the intake valve is closed. Most dense phase powder pumps comprise two feed chambers operating in time-staggered manner in order that alternatingly coating powder shall be aspirated into one feed chamber while the pertinent other feed chamber discharges coating powder.

Different kinds of coating powder feed apparatus containing a dense phase powder pump are known for instance from the following documents which are incorporated by reference herein: JP 09/071325 A;DE 196 11 533 B4; US 2005/012476 A1; US 2006/0193704 A1 (=EP 1 644 131 A2); U.S. Pat. No. 7,150,585 B2 (=WO 2004/087331 A1) and US 2005/0178325 A1 (=EP 1 566 352 A2). A vacuum intake of at least one of the two feed chambers and in some embodiment modes also the compressed air intake of the feed chamber is/are fitted with a filter permeable to air but not to coating powder. The preferred filter material is sintered. Predominantly the powder intake and outlet valves are pinch valves.

The powder rate fed by a dense phase powder pump in particular depends on the size (volume) of the feed chamber, on the frequency at which coating powder is aspirated into the feed chamber and then discharged from it, on the magnitude of the vacuum, on the time the powder intake valve is open during suction and on the flow impedances in the powder conduits upstream of the dense phase powder pump and especially downstream of it. The flow impedances depend in particular on the length and the inside cross-section of the powder conduits, mostly powder hoses. The compressed conveying air mixes only little with the coating powder which it pushes through the powder outlet valve out of the feed chamber.

The said document US 2005/0126476 A1 discloses a powder feed apparatus containing two blocks fitted with ducts aligned with each other at the interfaces of the said blocks affixed to each other in sealed manner. The dense phase powder pump's feed chambers are configured in one block. Control valves are affixed on the other block's side facing away from the first block and are connected to said ducts. As a result there are two interfaces that may incur sealing problems, namely in one case between the two blocks and in the other case between the other block and the control valves affixed to it. The ducts constituted in the other block bearing the control valves subtend large volumes requiring selective air evacuation or pressurization with compressed air during the operation of the dense phase powder pump. As a result there re operational delay times. These also limit the frequency at which the dense phase powder pump can deliver coating powder.

The objective of the present invention is reducing said sealing difficulties. Also the invention creates the possibility to shorten said delay times and hence raising operational speed.

The invention is elucidated below by means of illustrative embodiment modes and in relation to the appended drawings.

Figure 3:
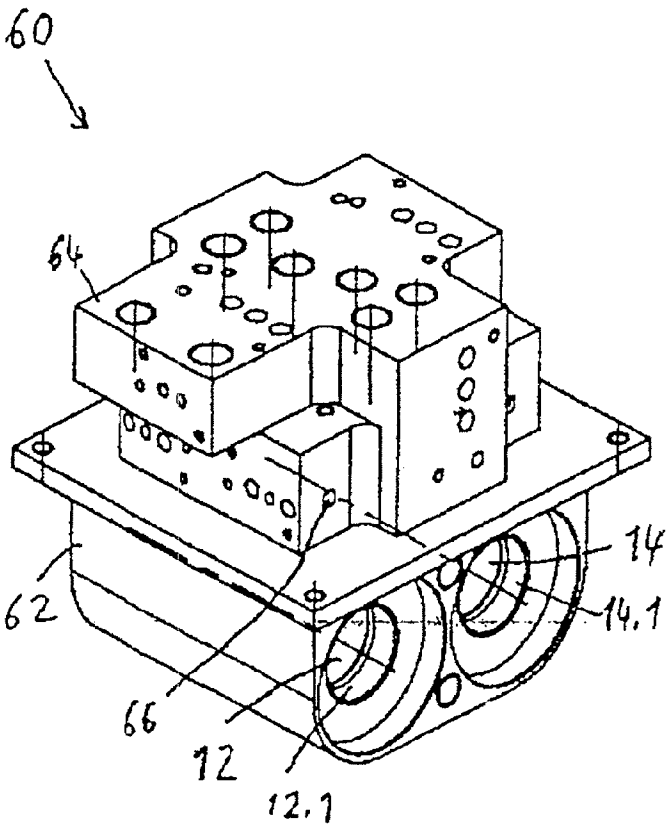
Figure 2:
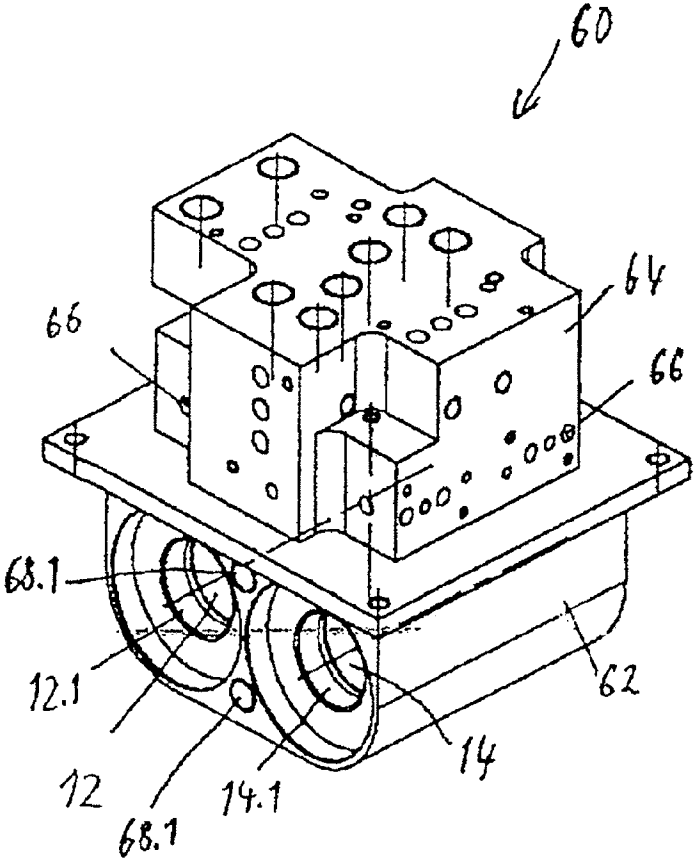
Figure 5:
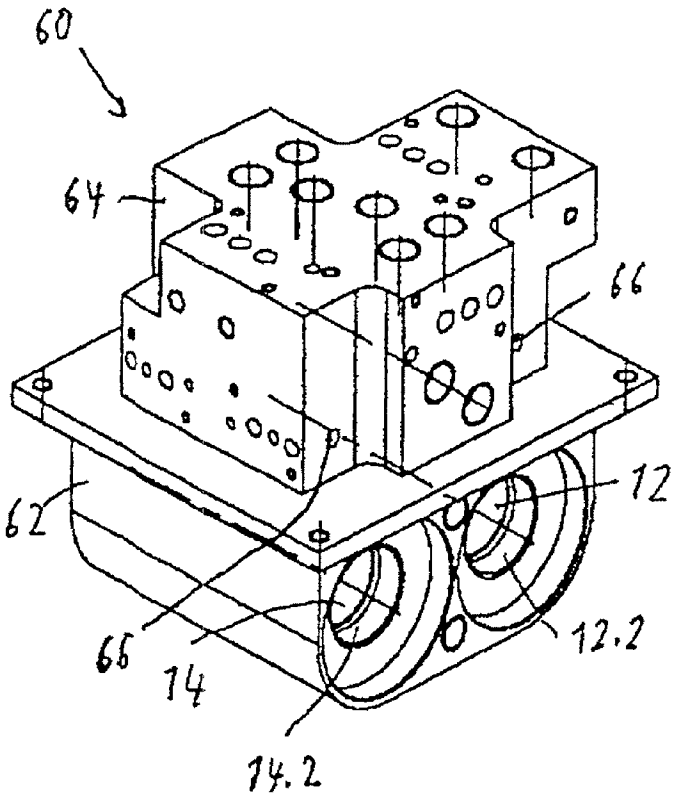
Figure 4:
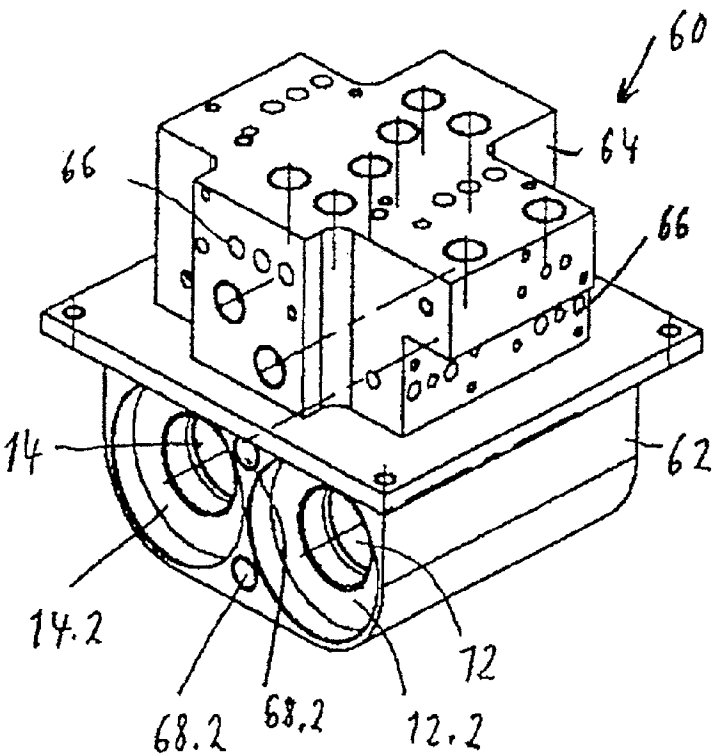
Figure 6:
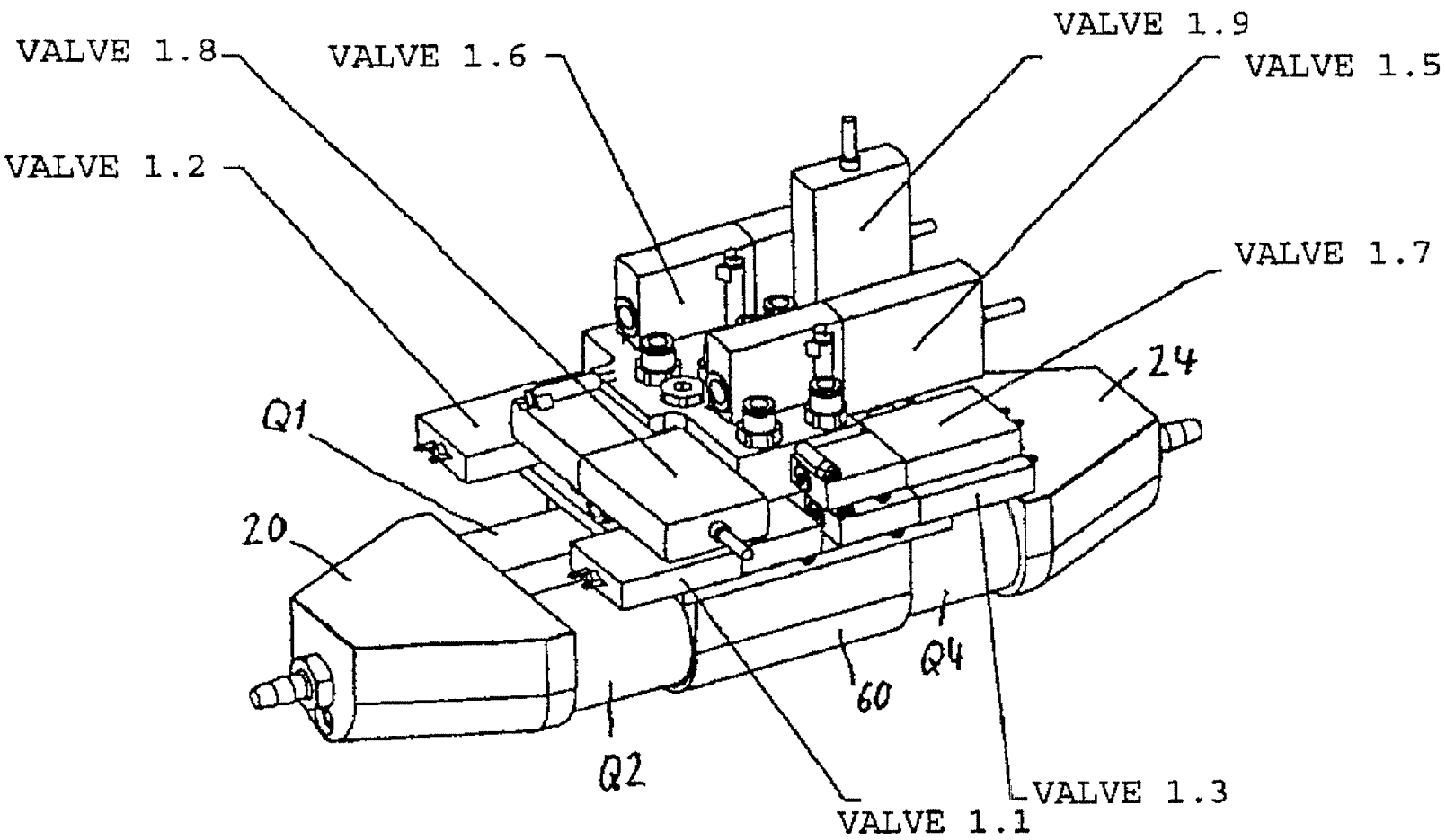
Figure 7:
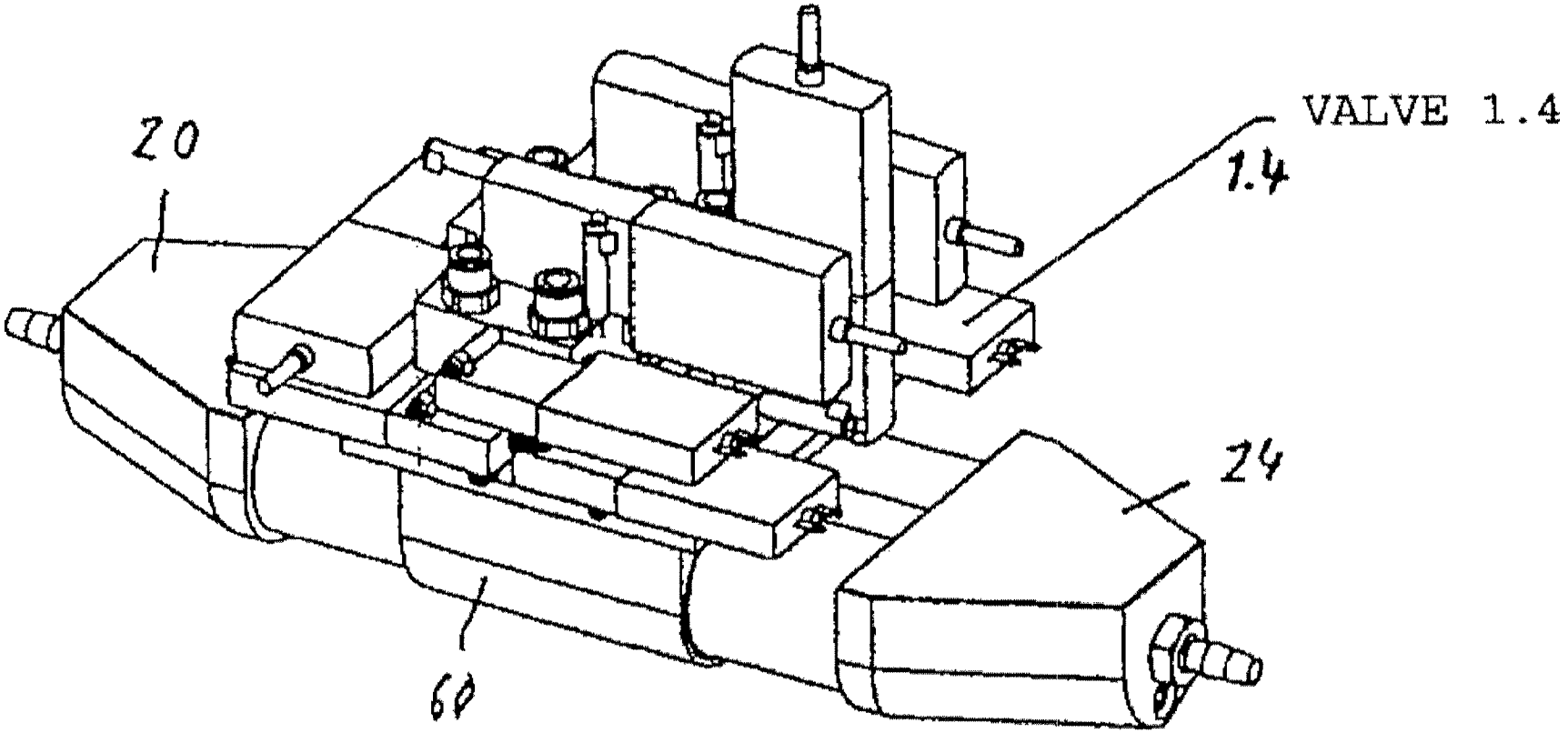
Figure 8:
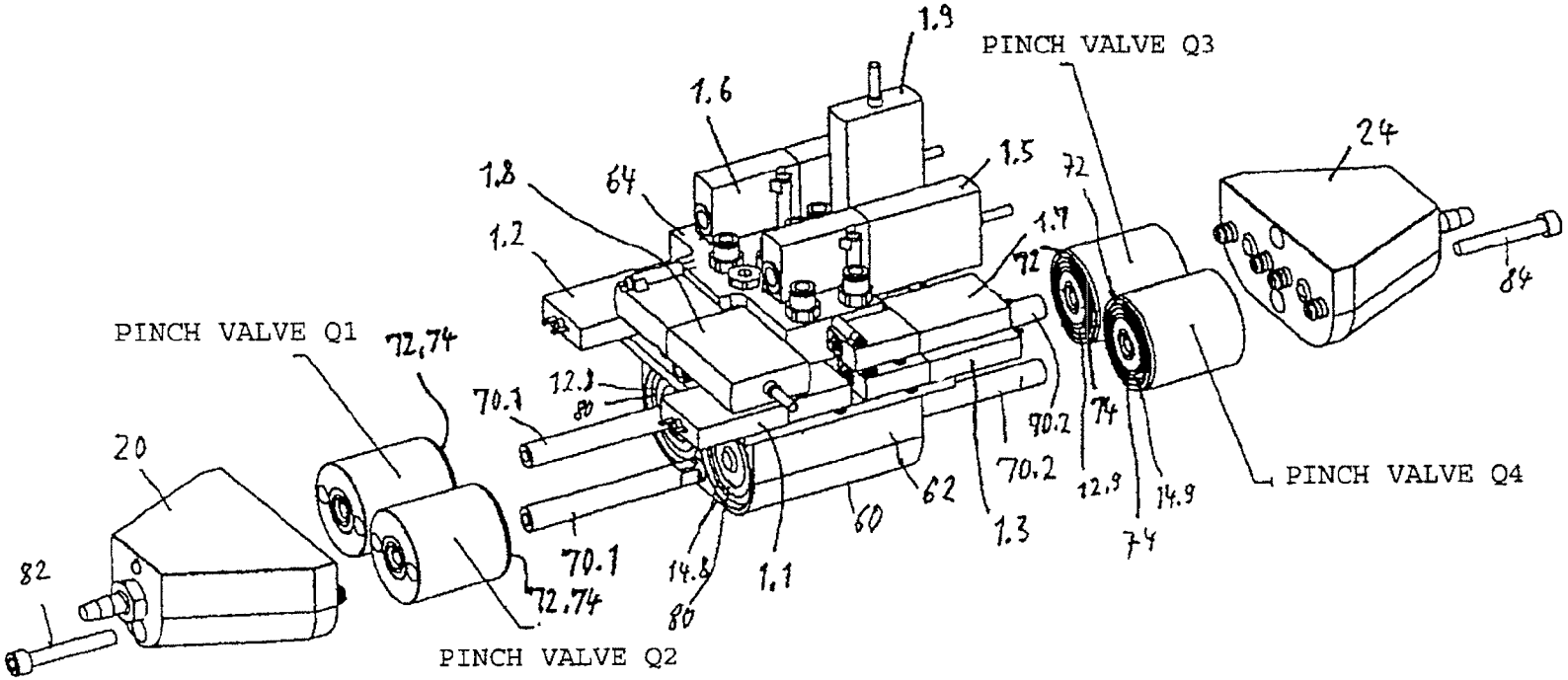

FIG. 1 schematically shows a powder spraycoating equipment fitted with a powder feed apparatus of the invention, FIGS. 2, 3 are perspective front views seen from different directions of an integral structural block of the invention, FIGS. 4, 5 are perspective views of the integral structural block's opposite end faces seen in two different directions, FIG. 6 is a perspective view of a special embodiment mode of a powder feed apparatus of the invention seen in a direction oblique to the powder intake side of a dense phase powder pump, FIG. 7 is a perspective view of the powder feed apparatus of FIG. 6 seen obliquely in the direction of the powder outlet side of the dense phase powder pump, and FIG. 8 is a perspective, exploded view of the powder feed apparatus of the invention seen at the same angle as in FIG. 6.

Figure 9:
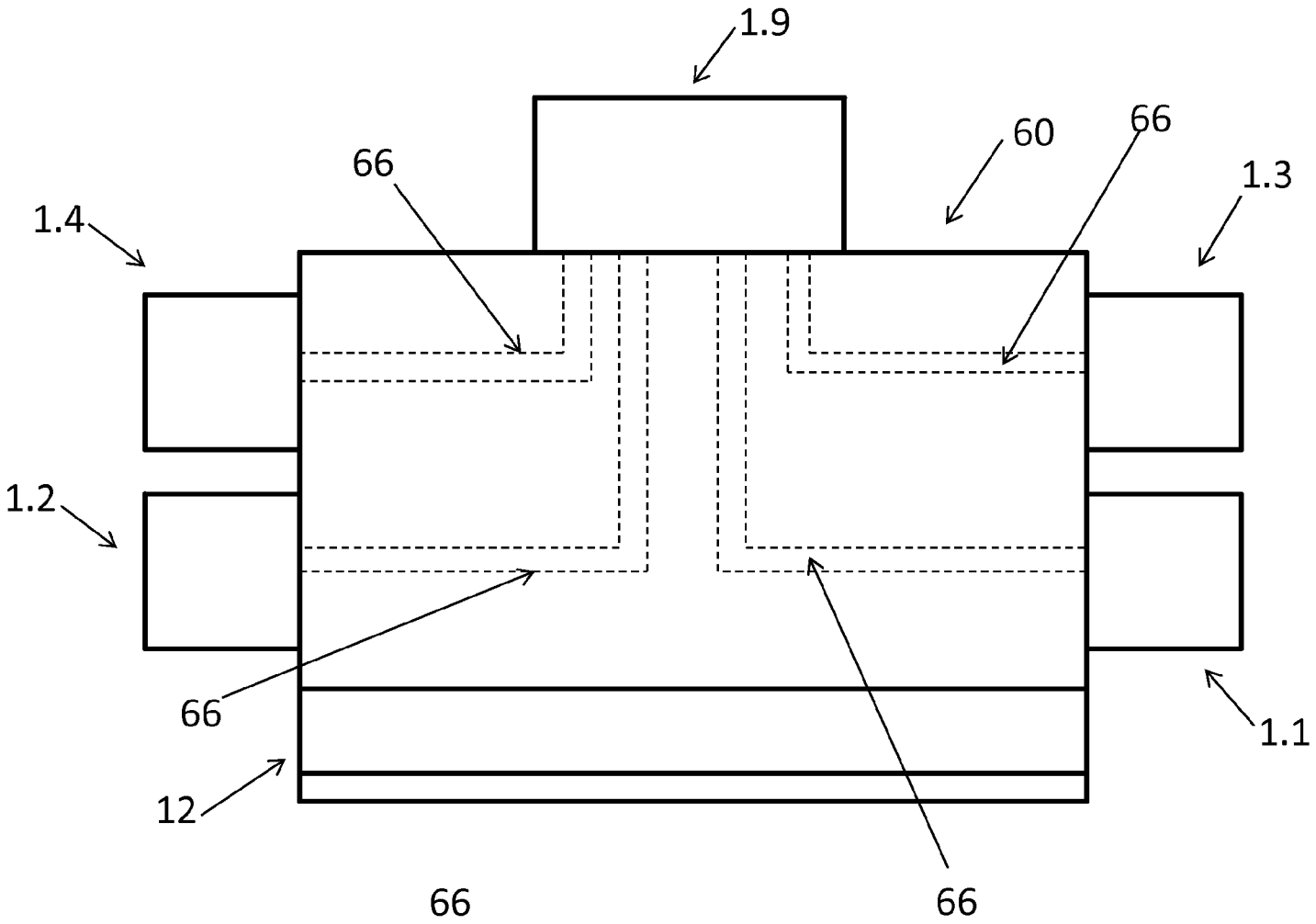

FIG. 9 is schematic drawing that shows the ducts in the integral structural block are in fluid communication with the third control valves and the fourth control valve.

FIG. 1 schematically shows a preferred embodiment mode of a powder feed apparatus of the invention which, together with a spray tool 26, constitutes a powder spraycoating equipment. The powder feed apparatus shown in FIG. 1 is one of several feasible embodiment modes of the present invention. The essential part of the present invention is the use of an integral structural block 60 shown in FIGS. 2 through 8 to which are affixed all the required components, namely powder intake valves and powder outlet valves as well as their associated control valves and are connected to ducts constituted in the structural block. On the other hand all the valves not directly connected to a feed chamber or to a powder intake valve or to a powder outlet valve may by connected to pneumatic conduits configured outside the said structural block.

A pneumatic circuit of a powder feed apparatus is described below as an example implying no restriction on the invention and is shown in FIG. 1.

The spray tool 26 may be a manually operated spray gun or a controlled, automated one. Preferably it contains at least one high voltage (hv) electrode 28 to which a hv source 30 applies hv to electrostatically charge the coating powder 17 sprayed by the spray tool 26. The hv source 30 may be integrated into the spray tool 26. Said spray tool may comprise a spray aperture 29 or a rotary atomizer.

The dense phase powder pump 10 contains at least one, preferably two feed chambers 12 respectively 14 each configured within a pump part or cylinder A and B. A powder intake valve Q1 respectively Q2 is configured at a powder intake 12.1 and 14.1 of the feed chamber 12 and 14. Powder outlet valves Q3 and Q4 each are configured at a powder outlet 12.2 and 14.2. The powder intake valves Q1 and Q2 and the powder outlet valves Q3 and Q4 are respectively directly connected to the powder intake 12.1 and 14.1 and the powder outlet 12.2 and 14.2. For clarity only, they are shown in FIG. 1 spaced respectively from the powder intake and the powder outlet.

Powder feed conduits 16.1 and 16.2 are connected to the intake side of the powder intake valves Q1 and Q2 and may run separately to one or two powder bins 18 or, as shown in FIG. 1, may be connected by a conduit branch element 20 to the common powder feed conduit 16 which runs into the powder bin 18.

The powder output side of the powder outlet valves Q3 and Q4 is connected by means of the powder discharge conduits 22.1 respectively 22.2 and the conduit branch element 24 to a common powder discharge conduit 22 in turn connected to the spray tool 26.

Preferably the conduit branch elements 20 and 24 are Y-shaped branches.

Each feed chamber 12 respectively 14 is alternatingly connectable during a suction stage to a vacuum source 44 or during a discharge stage to a source 44 of compressed conveying air. Coating powder is aspirated on account of a partial vacuum from the vacuum source 44 through the open powder intake valve Q1 and Q2 into the feed chamber 12 and 14 while the powder outlet valve Q3 or Q4 is closed.

The powder present in the feed chamber 12 respectively 14 is discharged through the open outlook valve Q3 respectively Q4 by means of the compressed conveying air from the compressed air source 48 while the powder intake valve Q1 or Q2 is closed. The two feed chambers 12 and 14 operate in mutually time-staggered manner whereby, alternatingly, coating powder is aspirated each time in either of the feed chamber 12 and 14 while the other feed chamber 14 or 12 is discharging coating powder.

The powder intake valves Q1 and Q2 and the powder outlet valves Q3 and Q4 may be controlled, arbitrary valves driven by the control unit 42. Preferably however they shall be pinch valves fitted with a flexible hose 32 which subtends a coating powder valve duct 34 and which can be squeezed together by compressed air present in the pressurized drive chamber 36 enclosing the hose 32 for the purpose of closing the valve duct 34. The hose 32 offers such resilience or intrinsic stress that after the pressure exerted by the compressed air is eliminated from the said pressurized drive chamber 36, said hose shall automatically straighten out and thereby open the valve duct 34.

FIG. 1 shows the feed chamber 12 during the suction stage when its powder intake valve Q1 is open and its powder outlet valve Q3 is closed. The other feed chamber 14 is in its powder discharge stage wherein its powder intake valve Q2 is closed and its powder discharge valve Q4 is open.

The powder intake valves Q1 and Q2 may be alternatingly fed by means of control valves 1.1 and 1.2 with compressed air from the compressed air source 48 or be vented into the external atmosphere (or be connected to the vacuum source). The powder outlet valves Q3 and Q4 alternatingly can be loaded with compressed air by means of control valves 1.3 and 1.4 from the compressed air source 48 or be vented (or connected to the vacuum source). Preferably a pressure regulator 2.2 shall be configured between the control valves 1.1, 1.2, 1.3 and 1.4 and the compressed air source 48. In the preferred embodiment mode of FIG. 1, a second pressure regulator 2.1 is configured in parallel with the pressure regulator 2.2 and one of the two pressure regulators can be connected by means of a further control valve 1.9 to the control valves 1.1, 1.2, 1.3 and 1.4. In this manner compressed air at the pressure of one of the pressure regulators 2.2 or at the pressure of the other pressure regulator 2.1 may alternatingly be applied to the powder valves Q1, Q2, Q3 and Q4.

An air exchange aperture 12.3 respectively 14.3 is fitted into a housing 12.6 and 14.6 to alternatingly apply a vacuum or compressed air to the feed chamber 12 or 14, said aperture communicating by means of an annular chamber 12.5 or 14.5 and a filter 12.4 or 14.4 with the feed chamber 12 or 14. The filter 12.4 respectively 14.4 is permeable to gases, in particular compressed air, but not to coating powder particles. The filter 12.4 respectively 14.4 advantageously constitutes the peripheral/circumferential wall of the feed chambers 12 and 14.

The air exchange apertures 12.3 and 14.3 can be alternatingly connected by control valves 1.5 and 1.6 and the control unit 42 with the compressed air source 48 or the vacuum source 44.

The present invention moreover may include a control valve 1.8 in order to directly connect the air exchange apertures/hookups 12.3 and 14. 3 to the compressed air source 48 instead of through a pressure regulator in the control unit 42.

A compressed air conduit 52 connects the control unit 42 to the control valves 1.5 and 1.6. Compressed air conduits 46 connect the compressed air source 48 to the pressure regulators 2.1 and 2.2.

Illustratively the vacuum source 44 may be fitted with an injector wherein a flow of compressed air creates a (partial) vacuum at a vacuum port 50. The compressed air illustratively may be fed by a pressure regulator 2.3 and a control valve 1.7 to the vacuum injector 44. The pressure regulator 2.3 is connected through the compressed air conduit 46 to the compressed air source 48. All control valves 1.1, 1.2, 1.3, 1.4, 1.5, 1.6, 1.7, 1.8 and 1.9 are driven by the control unit 42.

The electrical control unit 42 contains at least one computer driving the dense phase powder pump 10 by means of the control valves 1.1, 1.2, 1.3, 1.4, 1.5 and 1.6, and, to the extent being resorted to, also the control valves 1.7, 1.8 and 1.9.

FIGS. 2, 3, 4 and 5 show an integral structural block 60. In this instance "integral" means that the integral structural block is free of internal interfaces, instead being made continuously of the same material. It may be metallic or plastic.

In a lower part 62 said block contains the feed chambers 12 and 14 and in an upper part it is fitted with a plurality of boreholes 66 which issue from the external surface of the upper part 64 and which constitute the pneumatic conduits described below of the circuit for instance of FIG. 1.

Two threaded boreholes 68.1 respectively 68.2 are fitted in the lower block part 62 in both end faces and serve to affix the Y conduit branch elements 20 and 24 by means of by spacer tubes 70.1 and 70.2 (FIG. 8). Spacer rods also may be used in lieu of the spacer tubes 70.1 and 70.2.

The powder feed apparatus of the invention shown in FIGS. 2 through 8 is elucidated in the discussion below.

All first control valves 1.5 and 1.6, which are connected in fluid communication to the feed chambers 12 and 14 to implement the application of compressed conveying air and of vacuum, are configured at the integral structural block 60 and communicate directly by means of several of the ducts 66 constituted in the integral structural block 60 with the feed chambers 12 respectively 14.

The first control valves 1.5 and 1.6 may be downstream of the second control valve 1.8, where, in the present invention, the second control valve 1.8 is mounted on the structural block 60 and is connected, by means of the ducts 66 in said block and in fluid communication, directly with said control valves 1.5 and 1.6 as shown in the circuit of FIG. 1.

The powder intake valves Q1 and Q2 and the powder outlet valves Q3 and Q4 are configured at the opposite end faces of the structural block 60. The third control valves 1.1, 1.2, 1.3 and 1.4 are directly in fluid communication with the circuit of FIG. 1 by means of ducts 66 in the structural block 60 to apply and evacuate the drive air driving said powder intake and outlet valves Q1, Q2, Q3 and Q4.

Referring to FIG. 9, the third control valves 1.1, 1.2, 1.3 and 1.4 may be situated downstream of a fourth control valve 1.9, namely in that in the present invention the fourth control valve 1.9 is configured at the structural block 60 and is thus directly in fluid communication via ducts 66 in said block 60 with the third control valve 1.1, 1.2, 1.3 and 1.4.

In a preferred embodiment mode of the present invention, an axially parallel feedthrough 12.8, 14.8 respectively 12.9, 14.9 for the drive air of the powder valves Q1, Q2, Q3 and Q4 is configured between the end faces of the said powder intake valves Q1 and Q2 on one hand and the structural block 60 on the other and also between the powder outlet valves Q3 and Q4 on one hand and the structural block 60 on the other, those ducts 66 of the metal block 60 issuing into said feedthrough(s) which is/are directly in fluid communication with the third control valves 1.1, 1.2, 1.3, 1.4 to drive the powder valves Q1, Q2, Q3 and Q4.

Advantageously the feedthrough 12.8, 12.9, 14.8, 14.9 each time runs through a radial gap between two concentrically configured sealing annuli 72 and 74 each configured between the powder intake valves Q1 and Q2 and the structural block 60 and enclosing the powder path between the powder valves Q1 through Q4 and the structural block 60.

In an especially advantageous embodiment mode of the present invention, a drive air filter 80 is configured at the structural block 60 at the feedthrough 12.8, 12.9, 14.8, 14.9 and is permeable to said drive air but not to the coating powder and thereby prevents coating powder from entering the ducts 66 of the structural block 60 when the powder intake valves Q1 and Q2 and/or the powder outlet valves Q3 and Q4 are separated from the structural block 60, for instance for maintenance or replacement.

The powder intake valves Q1 and Q2 and/or the powder outlet valves Q3 and Q4 are each configured between the structural block 60 and either of the two conduit branch elements 20 respectively 24, and preferably are mounted in exchangeable manner.

In a special embodiment mode of the present invention, the Y shaped conduit branch elements 20 and 24 are detachably affixed to the structural block 60, the powder intake valves Q1 and Q2 are configured between the conduit branch element 20 and the structural block 60, the powder outlet valves Q3 and Q4 are configured between the other Y shaped conduit branch element 24 and the structural block 60, each in the longitudinal direction of the particular feed chamber 12 respectively 14, and clamped in sealed manner. This design allows rapid assembly and disassembly for instance in order to clean the Y conduit branch elements 20 respectively 24 and/or the powder valves Q1, Q2, Q3 and/or Q4, or to replace them. Merely two fastening screws 82 respectively 84 need be loosened for that purpose, or be tightened. The screws 82 and 84 may be screwed into spacer tubes 70.1 respectively 70.2 that are used to position the Y conduit branch elements 20 and 24.

Preferably further ducts are fitted into the structural block 60 that run from the side of the first control valves 1.5 and 1.6 away from the feed chambers 12 and 14 to an outside of the structural block 60 to allow connecting—at the outside of said block—said ducts to the vacuum port 50 of the vacuum source 44.

The invention claimed is:

1. A powder feed apparatus for a powder spraycoating equipment, said powder feed apparatus comprising:

an integral structural block including ducts, said integral structural block having a first end face and a second end face opposite to the first end face, wherein the integral structural block is made continuously of the same material;

a dense phase powder pump having at least two feed chambers located within the integral structural block, said at least two feed chambers each comprising a first end and a second end opposite to the first end, said at least two feed chambers respectively having at least one air exchange aperture to alternate between applying compressed conveying air and applying vacuum to the respective feed chamber;

respective powder intake valves located at the first ends of the at least two feed chambers and respective powder outlet valves at the second ends of the at least two feed chambers, said powder intake valves being located at the first end face of the integral structural block and said powder outlet valves being located at the second end face of the integral structural block, and a plurality of first control valves directly arranged at the integral structural block, and each first control valve directly connected, in fluid communication by the ducts, to the respective feed chambers for applying the alternating compressed conveying air and the vacuum to the respective feed chambers such that powder is aspirated in the respective feed chambers and subsequently discharged upon opening of the respective powder outlet valves.

2. The powder feed apparatus as claimed in claim 1, further comprising at least one second control valve which is configured upstream of the first control valves, and the second control valve is configured at the integral structural block, and is connected in fluid communication with the first control valves by the ducts.

3. The powder feed apparatus as claimed in claim 1, further comprising at least one second control valve which is connected in fluid communication with the first control valves by the ducts and third control valves directly connected, in fluid communication by the ducts, to the respective powder intake valves and the respective powder outlet valves of the respective feed chambers for applying and evacuating drive air.

4. The powder feed apparatus as claimed in claim 3, further comprising at least one fourth control valve which is configured upstream of the third control valves, wherein the fourth control valve is configured at the integral structural block, and is directly connected, in fluid communication via the ducts, to the third control valves.

5. The powder feed apparatus as claimed in claim 3, wherein the integral structural block further comprises, for the respective feed chambers, a feedthrough for the drive air of the powder intake and powder outlet valves, the feedthrough is between end faces of the powder intake and powder outlet valves, and between the first end and the second end of the respective feed chambers in the integral structural block, and the ducts are directly connected in fluid communication to the third control valves, the ducts issuing into said feedthrough.

6. The powder feed apparatus as claimed in claim 5, wherein the feedthrough runs through a radial gap, and the radial gap is between two mutually concentric sealing annuli which are configured between the powder intake valves and the powder outlet valves, and which enclose a powder path between the powder intake valves and the powder outlet valves in the integral structural block.

7. The powder feed apparatus as claimed in claim 5, further comprising a drive-air filter at the feedthrough of the integral structural block, wherein said drive-air filter is permeable to the drive air but not to powder.

8. The powder feed apparatus as claimed in claim 1, wherein each of the powder intake valves is configured between the integral structural block and a first conduit branch element, and each of the powder outlet valves is configured between the integral structural block and a second conduit branch element.

9. The powder feed apparatus as claimed in claim 8, wherein the first and second conduit branch elements are detachably affixed to the integral structural block, and the powder intake valves and the powder outlet valves are each configured in a sealed manner in a longitudinal direction of the respective feed chamber.

10. The powder feed apparatus as claimed in claim 1, wherein the respective powder intake valves and powder outlet valves are pinch valves each having a flexible hose, and said each hose is radially pinched until closure by compressed drive air in a pressurized chamber enclosing the hose.

11. The powder feed apparatus as claimed in claim 1, further comprising a vacuum source including a vacuum port adapted to be connected with the ducts in the integral structural block.

12. The powder feed apparatus as claimed in claim 5, wherein the feedthrough is axially parallel with the respective feed chambers.

13. A powder feed apparatus for a powder spraycoating equipment, said powder feed apparatus comprising:

an integral structural block including ducts, said integral structural block having a first end face and a second end face opposite to the first end face;

a dense phase powder pump having at least one feed chamber located within the integral structural block, said at least one feed chamber comprising a first end and a second end opposite to the first end, said at least one feed chamber having at least one air exchange aperture to alternatingly apply compressed conveying air or vacuum to the at least one feed chamber;

at least one powder intake valve at the first end of the at least one feed chamber, and at least one powder outlet valve at the second end of the at least one feed chamber, said at least one powder intake valve being configured at the first end face of the integral structural block and said at least one powder outlet valve being configured at the second end face of the integral structural block, wherein said at least one powder intake valve and said at least one powder outlet valve are operated by drive air; and at least one first control valve directly arranged at the integral structural block and directly connected, in fluid communication by the ducts, the at least one feed chamber for applying the compressed conveying air or the vacuum to the at least one feed chamber, wherein the integral structural block is made continuously of the same material, and the dense phase powder pump further comprises at least one second control valve configured at the integral structural block, and third control valves directly connected, in fluid communication by the ducts, to the at least one powder intake valve and the at least one powder outlet valve of the at least one feed chamber for applying and evacuating said drive air; and further comprising at least one fourth control valve which is configured upstream of the third control valves, wherein the fourth control valve is configured at the integral structural block, and is directly connected, in fluid communication via the ducts, to the third control valves.

* * * * *